US008298127B2

(12) United States Patent
Terhaag

(10) Patent No.: US 8,298,127 B2
(45) Date of Patent: Oct. 30, 2012

(54) FOLDING METHOD AND FOLDING APPARATUS

(75) Inventor: Michiel A. C. Terhaag, Melick (NL)

(73) Assignee: OCE Technologies B.V., Venlo (NL)

( * ) Notice: Subject to any disclaimer, the term of this patent is extended or adjusted under 35 U.S.C. 154(b) by 0 days.

(21) Appl. No.: 13/024,388

(22) Filed: Feb. 10, 2011

(65) Prior Publication Data

US 2011/0130262 A1 Jun. 2, 2011

Related U.S. Application Data

(63) Continuation of application No. PCT/EP2009/059659, filed on Jul. 27, 2009.

(30) Foreign Application Priority Data

Aug. 11, 2008 (EP) ..... 08162144

(51) Int. Cl.
*B31B 1/00* (2006.01)

(52) U.S. Cl. ..... 493/409; 493/433; 493/451; 493/430

(58) Field of Classification Search ..... 493/409, 493/433, 430, 405, 423, 424, 428, 432, 435, 493/441, 442, 448, 451
See application file for complete search history.

(56) References Cited

U.S. PATENT DOCUMENTS

| | | | | |
|---|---|---|---|---|
| 1,791,569 A | | 2/1931 | Novick | |
| 3,904,186 A | * | 9/1975 | De Ligt | 493/422 |
| 3,991,994 A | | 11/1976 | Farish | |
| 4,070,014 A | * | 1/1978 | Takahashi | 270/39.09 |
| 4,109,902 A | * | 8/1978 | Barrer | 493/444 |
| 4,484,905 A | * | 11/1984 | Ashburner | 493/415 |
| 4,597,752 A | * | 7/1986 | Muller et al. | 493/410 |
| 4,846,454 A | * | 7/1989 | Parkander | 270/5.02 |
| 5,062,597 A | * | 11/1991 | Martin et al. | 270/39.02 |
| 5,131,640 A | | 7/1992 | Crowley | |
| 5,279,536 A | | 1/1994 | Abreu | |
| 5,344,379 A | * | 9/1994 | Garrone | 493/441 |
| 5,360,213 A | * | 11/1994 | Crowley et al. | 270/39.05 |
| 5,616,113 A | * | 4/1997 | Van Den Bergh | 493/23 |
| 5,989,174 A | | 11/1999 | Patrizio | |
| 6,511,408 B2 | * | 1/2003 | Miki et al. | 493/413 |

FOREIGN PATENT DOCUMENTS

| | | |
|---|---|---|
| EP | 1 842 818 A1 | 10/2007 |
| GB | 2 196 944 A | 5/1988 |

* cited by examiner

*Primary Examiner* — Sameh H. Tawfik
(74) *Attorney, Agent, or Firm* — Birch, Stewart, Kolasch & Birch, LLP

(57) ABSTRACT

A folding method includes feeding a sheet to be folded to a folding unit, folding the sheet repeatedly by the folding unit, thereby creating a folded package, and discharging at least a part of the folded package from the folding unit. While at least a part of the folded package is discharged from the folding unit in the step of discharging, a part of the sheet is held back. The method includes unfolding at least one fold of the folded package. A folding apparatus is provided for carrying out the method.

4 Claims, 10 Drawing Sheets

FOLDING METHOD AND FOLDING APPARATUS

CROSS-REFERENCE TO RELATED APPLICATIONS

This application is a Continuation of International Application No. PCT/EP2009/059659, filed on Jul. 27, 2009, and for which priority is claimed under 35 U.S.C. §120, and claims priority under 35 U.S.C. §119(a) to Application No. 08162144.3, filed in Europe on Aug. 11, 2008. The entirety of each of the above-identified applications is expressly incorporated herein by reference.

BACKGROUND OF THE INVENTION

1. Field of the Invention

The present invention relates to a method of folding a sheet, comprising feeding a sheet to be folded to a folding unit, repeatedly folding the sheet with the folding unit, thereby creating a folded package, and discharging at least a part of the folded package from the folding unit.

The present invention further relates to a folding apparatus for carrying out the method of the invention, in particular a folding apparatus for wide format printing systems.

2. Background of the Invention

Preferably, the folding unit is adapted for forming at least one fold at a not weakened position of the sheet, i.e. at a not previously folded, perforated or otherwise weakened position. Preferably, in the folding step, at least one fold is formed at a not weakened position of the sheet. Thus, the method is suitable for folding a printed sheet at previously unweakened positions. This is in contrast to a method of folding a paper web at pre-weakened fold lines as described in U.S. Pat. No. 5,279,536.

The sheet may be a printed sheet, i.e. a sheet printed in a printing apparatus, e.g. a printer or copier.

U.S. Pat. No. 5,989,174 describes a zig-zag folding method and apparatus wherein a folded web is continuously discharged from a folding station and collected on a collection shelf. The folding apparatus requires a complicated structure which is prone to inaccurate folding. A step of discharging the collected web from the collection shelf is not disclosed.

From U.S. Pat. No. 5,131,640, a method for processing web material is known, wherein, in a folder/cutter, the web is folded to produce a zig-zag pattern and cut into folded sheets. The folded sheets are discharged from the folder/cutter and are stacked on an output stack. The structure of the folder/cutter is not described, and a step of discharging the stack of folded sheets from the output stack is not disclosed.

GB 2 196 944 describes folding a continuous running paper web in zig-zag formation. A completed stack is moved laterally away from the stacking station so that a topmost panel of the stack or a lowermost panel of the remainder of the pile is unfolded, and the web is broken between such panels by tearing it or severing it.

EP 1 842 818 discloses a folding method and apparatus of the type mentioned initially. After forming the folds on a folding cylinder, the created folded package is unloaded from the folding cylinder and discharged by rotating the folding cylinder. The folding apparatus produces a precisely folded package while having a simple and compact configuration. However, the folding length (i.e., the length of the sheet that can be folded) is limited due to the structure of the folding unit, because with an increasing length of the sheet, the number of the folds and thus the number of the layers in the folded package held on the folding cylinder increases, and folding tolerances increase. A typical limit for the length of the sheet, e.g. a continuous paper web, is six meters.

SUMMARY OF THE INVENTION

However, there is a need for longer folding lengths in the mining, railway, electric and chemical industries, for example.

It is an object of the present invention to provide a folding method and a folding apparatus of the type indicated above which allow larger folding lengths and a higher number of folds, while using an apparatus with a simple construction.

It is a further object of the present invention to provide a folding method of the type indicated above for usage with a folding unit having only a limited capacity for a folded package in the folding unit, e.g. due to the nature of the folding process, the method allowing folding lengths and/or numbers of folds that exceed the capacity of the folding unit for the folded package.

In order to achieve these objects, a method of folding a sheet is provided. According to the invention, while at least a part of the folded package is discharged from the folding unit in the discharge step of the folding method, a part of the sheet is held back, and the method comprises unfolding at least one fold of the folded package.

In particular, the folded package created in the folding step comprises only a part of the sheet. For example, in the folding step, only a part of the sheet is folded. After a part of the folded package has been discharged from the folding unit, the folding of the sheet by the folding unit may continue. Thus, a long sheet may be folded package-wise creating comparatively small packages and finally delivering the sheet as one larger, single package. Thus, the capacity of the folding unit for the folded package does not limit the folding length or the number of folds. Therefore, the folding unit can be optimized to a certain maximum folding capacity of, for example, corresponding to a sheet length of three meters, resulting in improved folding tolerances and reduced costs of the folding apparatus.

By unfolding at least one fold, which had already been folded by the folding unit, a regular pattern of folding intervals and folding orientations of the folds of a new folded package and a previous folded package may be established, without interruption.

The sheet may be held back, e.g., in or at the folding unit and/or in or at the feed unit. Preferably, the discharged part of the folded package is a front part of the sheet relative to the part of the sheet which is held back.

Preferably, the unfolding step is performed after creating the folded package. More preferably, the unfolding step is performed fully or partly concurrently with the discharge step or after the discharge step. Preferably, in the unfolding step, the at least one fold is completely unfolded, i.e. the sheet is straightened at the position of the fold.

Preferably, creating the folded package is done by accumulating said folded package, wherein each newly formed fold, except for a number of initial folds, is pressed against the so far accumulated portion of the folded package while being added to said currently accumulated portion of the folded package. For example, said newly formed fold is pressed against the so far accumulated portion of the folded package by a pinch element of a pinch structure.

In the folding step, the sheet is folded at least twice. Preferably, the folded package is a closely folded package, that is, being configured of stacked layers, consisting of a bottom layer and further layers, each further layer being immediately on top of a neighboring layer, connected to said neighboring layer through a fold.

Preferably, the folding unit comprises a folding substrate, and, in the folding step, the folded package is created being stacked on the folding substrate.

Holding back a part of the sheet while discharging at least a part of the folded package has also advantages when the sheet has already been folded completely, since it allows keeping control of the sheet, and, e.g., re-feeding the sheet backwards in order to execute a further finishing procedure.

Further useful details of the invention are indicated in the dependent claims.

Preferably, the folding unit comprises a folding substrate, and the sheet to be folded is fed towards a support surface of the folding substrate, and, in the folding step, the sheet is repeatedly folded by driving the folding substrate back and forth in a surface direction of said support surface and folding the sheet between the folding substrate and at least one pinch member of a pinch structure, thereby creating the folded package, and, in the discharge step, at least a part of the folded package is unloaded from the folding substrate.

Thus, a front edge of the sheet is guided by the support surface being driven, even in the case of a comparatively stiff sheet. By driving the folding substrate back and forth, front folds and rear folds may be created while stacking the layers on the folding substrate. Thus, the folding unit may have a compact and simple structure.

Preferably, the pinch structure comprises at least a first pinch member and a second pinch member, and the sheet to be folded is fed towards the support surface between said first and second pinch members, and, in the folding step, front folds are folded between the first pinch member and the folding substrate, and rear folds are folded between the second pinch member and the folding substrate. By providing distinct pinch members for creating the front and rear folds, each pinch member may have a simple structure.

For example, the folded package is a fanfolded package, i.e., the intervals of the sheet between successive front folds and rear folds are uniform and equal to the intervals between successive rear folds and front folds. This facilitates handling of the folded package.

Preferably, the sheet is fed towards the support surface and a first side of a first pinch member of the pinch structure, and, in the discharge step, at least a part of the folded package is moved through a nip between said first pinch member and the folding substrate to a second side of the pinch member, such that a least one front fold and at least one rear fold of said at least part of the folded package are at the second side of the pinch member, and, while at least a part of the folded package is unloaded from the folding substrate and is discharged in the discharge step, a part of the sheet is held back between the pinch member and the folding substrate.

Whereas, when a fold is formed, the sheet may be pinched between the first pinch member and the folding substrate, in the discharge step, however, said part of the folded package being moved to the second side of the pinch member is released from being pinched. Thus, said part of the folded package, or a part of said part, may be unloaded and discharged, for example, by being dropped from the folding substrate.

Preferably, said at least part of the folded package, or a part of it, is discharged to a delivery unit.

Preferably, the part of the sheet which is held back between the pinch member and the folding structure is pinched between the pinch member and the folding structure. This facilitates maintaining control over the position of the sheet. However, holding back a part of the sheet between the pinch member and the folding substrate does not require that the sheet is pinched between the pinch member and the folding substrate. For example, a rear part of the sheet may be pinched at a feed unit of the folding apparatus while another part of the sheet extends through the nip between the pinch member and the folding substrate without being pinched there.

After the at least part of the previously folded package has been discharged from the folding unit in the discharge step, the folding step is repeated wherein at least a section of the sheet which has not been folded in the previous folding step is folded, thereby creating a new folded package, and at least a part of the new folded package is discharged from the folding unit. A part of the previous folded package may also be a part of the new folded package. The newly folded section of the sheet and the previous folded package are continuous. That is, there is no break or gap in the sheet separating them. Thus, the folding length is not limited by the folding capacity of the folding unit.

Preferably, said at least part of the new folded package is discharged to the delivery unit. Preferably, the previously folded package and the discharged at least part of the new folded package are combined into a single folded package at the delivery unit.

Preferably, after discharging the at least part of the folded package from the folding unit, and before repeating the folding step, the sheet is positioned such that folding intervals and folding orientations of the folds of the new folded package and folding intervals and folding orientations of the folds of the previous folded package together form a regular pattern, in particular a regular, e.g. fanfold, pattern on a continuous part of the sheet. For example, the sheet is positioned by the folding unit and/or by the feed unit.

Preferably, the folding method comprises a retracting step of retracting the sheet, e.g. after creating the folded package; more preferably after discharging said at least part of the folded package from the folding unit, and even more preferably after said holding back of a part of the sheet. The retracting step may fully or partly be concurrent with the unfolding step and/or the unfolding step. Retracting the sheet a certain length facilitates repositioning the sheet after discharging a part of the folded package. Moreover, rectracting the sheet may result in performing the unfolding step.

In a second aspect, the invention relates to a folding apparatus, comprising: a folding unit configured to repeatedly fold a sheet in order to create a folded package; a feed unit configured to feed or supply a sheet to be folded to the folding unit; a delivery unit configured to discharge the folded sheet; and a control unit configured to control at least the feed unit and the folding unit. Preferably, the feed unit is adapted to supply and retract the sheet.

In order to achieve the object of the invention, the control unit is adapted to carry out the folding method described above. That is, the control unit is adapted to control the folding unit and/or the feed unit and/or the discharge unit in order to make the folding apparatus carry out said method.

Preferably, the folding unit comprises a folding substrate forming a support surface for the sheet and adapted to be driven back and forth in a surface direction of said support surface; and a pinch structure having at least one pinch member for folding the sheet between the support surface and said at least one pinch member. The pinch member is, for example, a pressure roller adapted to be pressed against the support surface. Preferably, the control unit is adapted to control the folding substrate and/or the pinch member(s).

Preferably, the folding apparatus comprises a buffer unit configured to buffer a section of the sheet, said buffer unit being arranged upstream of the folding unit and, more preferably, upstream of the feed unit. This allows buffering a part of the sheet, e.g. while the sheet is retracted in the folding unit and/or the feed unit. Thereby, when the folding apparatus is connected to a printing apparatus, the printing apparatus can be operated independently of the folding process.

In a third aspect, the object of the invention is achieved by a printing system comprising an in-line combination of a printing apparatus and a folding apparatus as described above. The printing system comprises a sheet path from the printing system to the folding apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
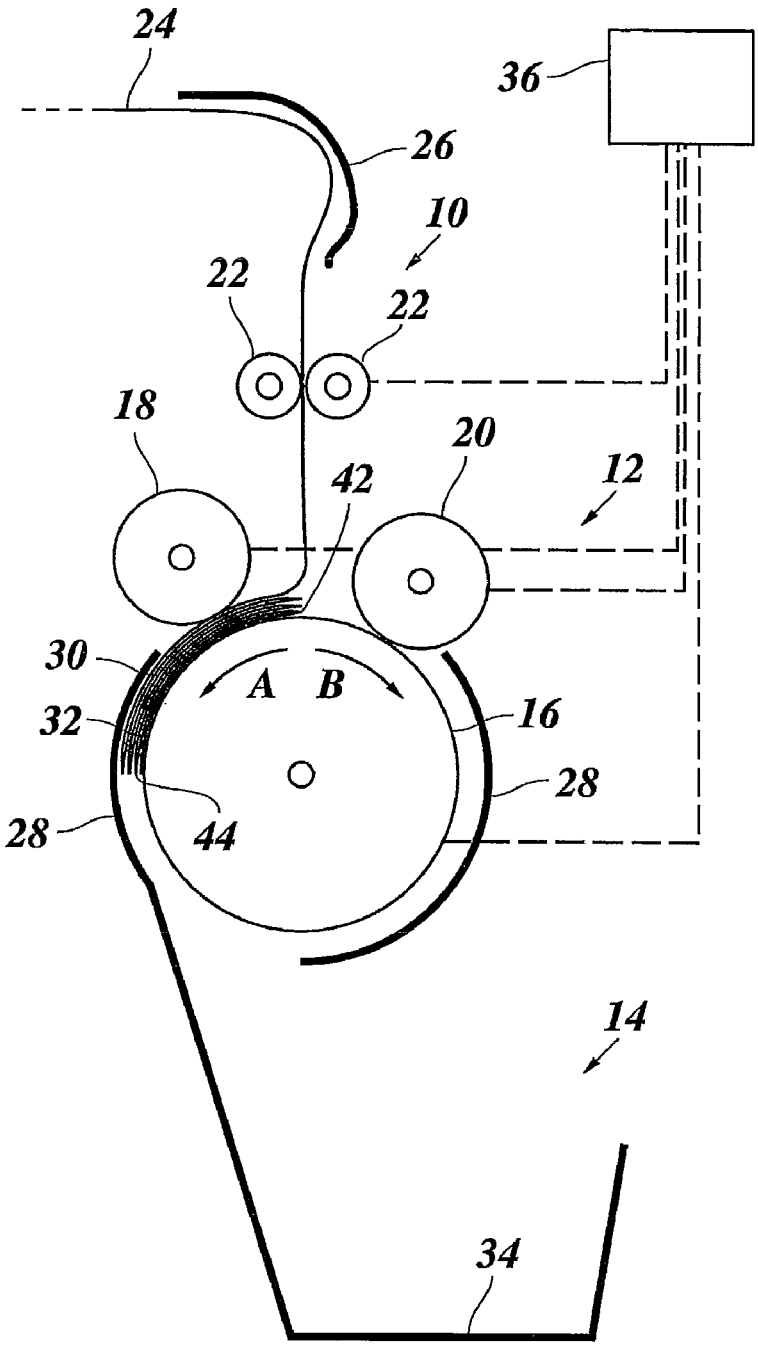
FIG. 1 is a schematic view of a folding apparatus.

The present invention will now be described with reference to the accompanying drawings, wherein the same reference numerals have been used to identify the same or similar elements throughout the several views.

As it is shown in FIG. 1, a folding apparatus comprises a feed unit 10, a folding unit 12 and a delivery unit 14. The folding unit 12 comprises a folding substrate, which is configured as a cylindrical drum 16, and a pinch structure comprising first and second pinch members in the form of press cylinders 18, 20, that are arranged substantially symmetrically with respect to the feed unit 10 at the peripheral surface of the drum 16. The delivery unit 14 is arranged in a position approximately diametrically opposite to the feed unit 10.

The press cylinders 18, 20 are able to engage with the folding substrate 16 to form a folding pinch between each of the press cylinders 18, 20 and the folding substrate 16. The press cylinders 18, 20 are positioned on pivotable arms (not shown) to be able to vary the distance between the press cylinders 18, 20 and the folding substrate 16 to be able to cope with a folded package. The press cylinders 18, 20 are pressed against the folding substrate 16, for example, by resilient means, e.g. a spring.

The feed unit 10 comprises a pair of feed rollers 22 that form a nip. At least one of the feed rollers 22 is driven so as to control the supply of a sheet 24 to the folding substrate 16 and to control an operation of retracting the sheet 24. The sheet 24 is fed to the feeding nip between the feed rollers 22 via a curved guide member 26.

Around the periphery of the folding substrate 16, guide members 28 are arranged for guiding and protecting a folded package 30 present on a support surface 32 of the folding substrate 16. A guiding member 28 on the side of the first press cylinder 18 is formed in order to be able to guide a package 30 into a tray 34 of the delivery unit 14, when the package 30 is unloaded from the folding substrate 16, thereby discharging the package 30.

The control unit 36 controls the feed rollers 22 of the feed unit 10, and the folding substrate 16 and the press cylinders 18, 20 of the folding unit 12. In the example shown, the press cylinders 18, 20 are driven. However, the press cylinders 18, 20 may also be adapted to rotate freely with the folding substrate 16.

The function principle of the folding unit will now be explained in conjunction with FIG. 2. The initial stage of the folding method is similar to the folding method described in EP 1 842 818 A1 with reference to FIGS. 1 to 8 of that document.

The sheet 24, e.g. a sheet of a recording sheet exiting from a printer, is supplied towards the feed rollers 22 of feed unit 10. The feed unit 10 aligns the sheet 24 by rotating the feed rollers 22 in a backwards direction, until the leading edge 38 of the sheet 24 is completely positioned in front of the nip of the feed rollers 22. Then, the rotation of the feed rollers 22 is reversed, and the feed unit 12 feeds the sheet 24 towards the folding substrate 16 in between pinch members 18 and 20. Thus, the control unit 36 knows the position of the leading edge 38 of the sheet. In the following, the control unit 36 controls the position of the sheet 24 relative to the folding substrate 16 and relative to the feed rollers 22, throughout.

Figure 2:
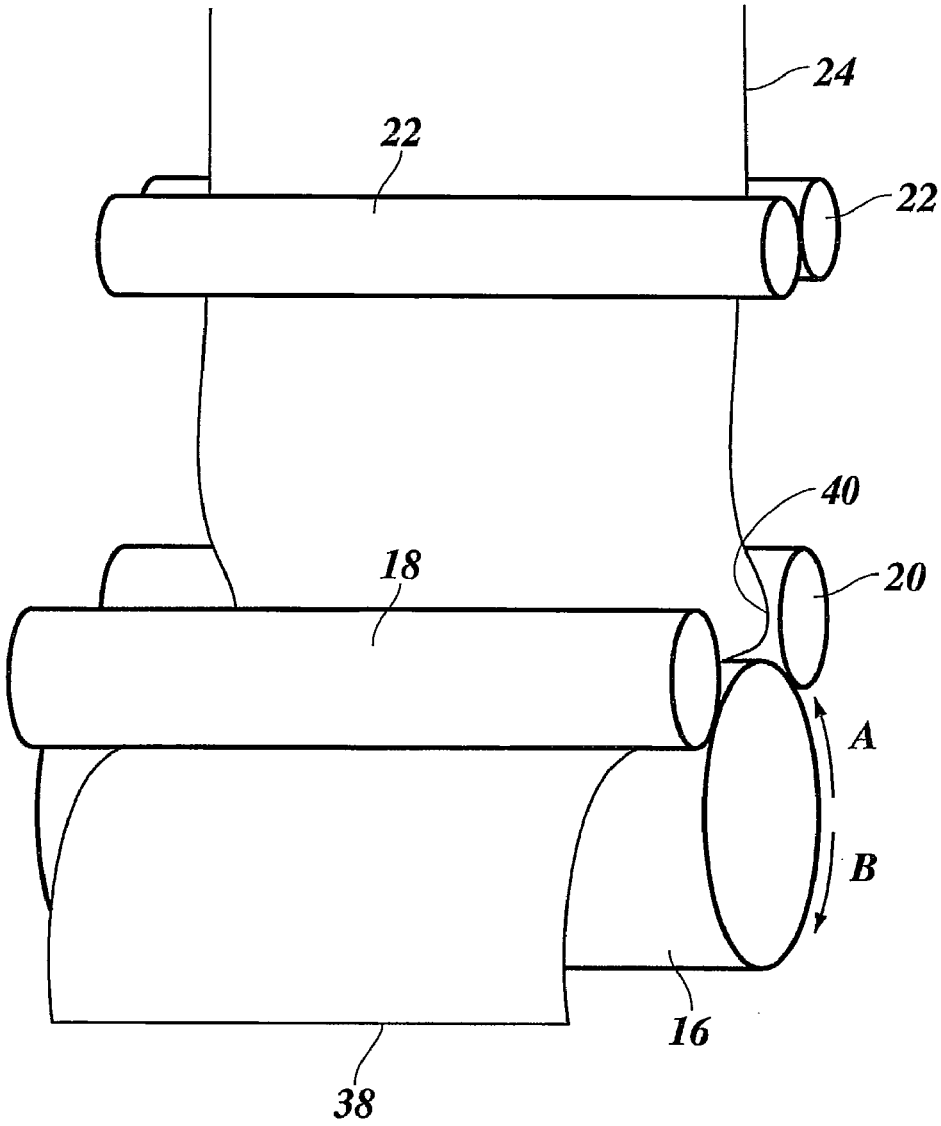
FIG. 2 is a schematic perspective view showing a feed unit and a folding unit of the folding apparatus.
Figure 3:
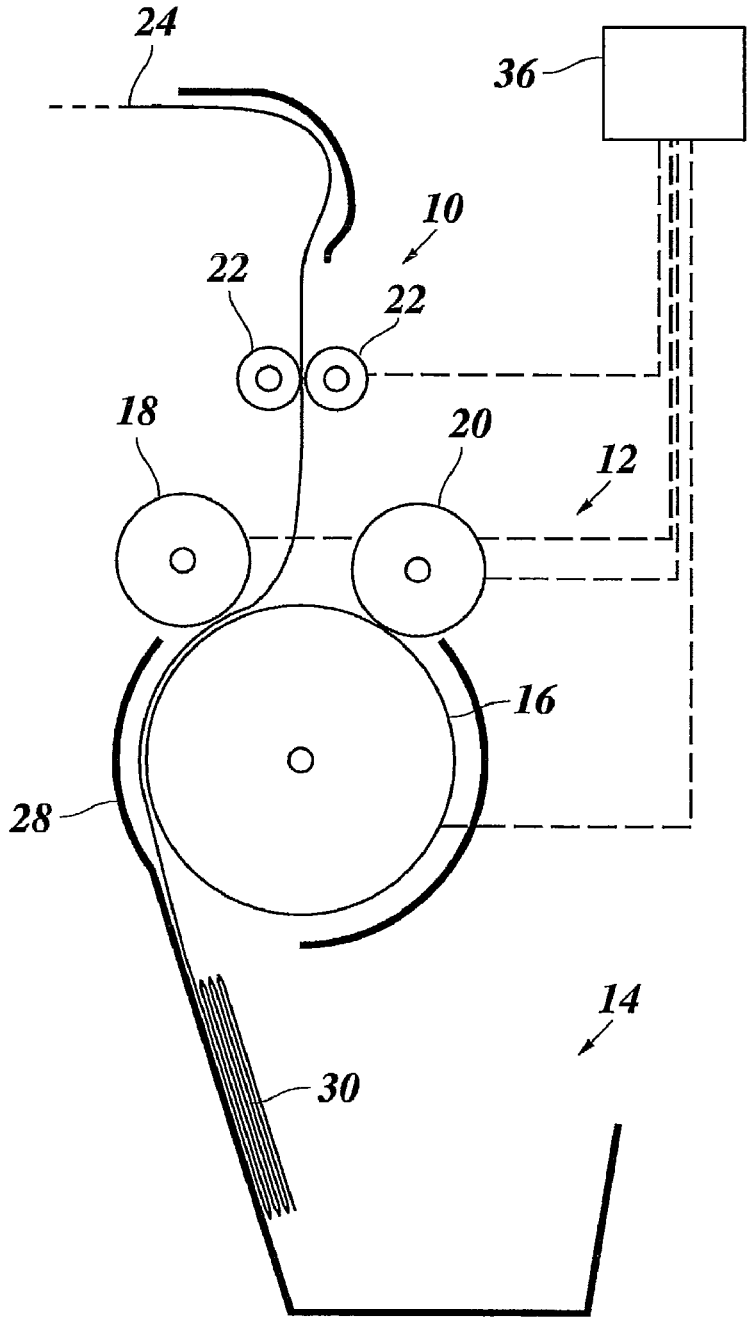
FIGS. 3-8 are schematic views similar to FIG. 1, illustrating different stages of a folding method.
Figure 4:
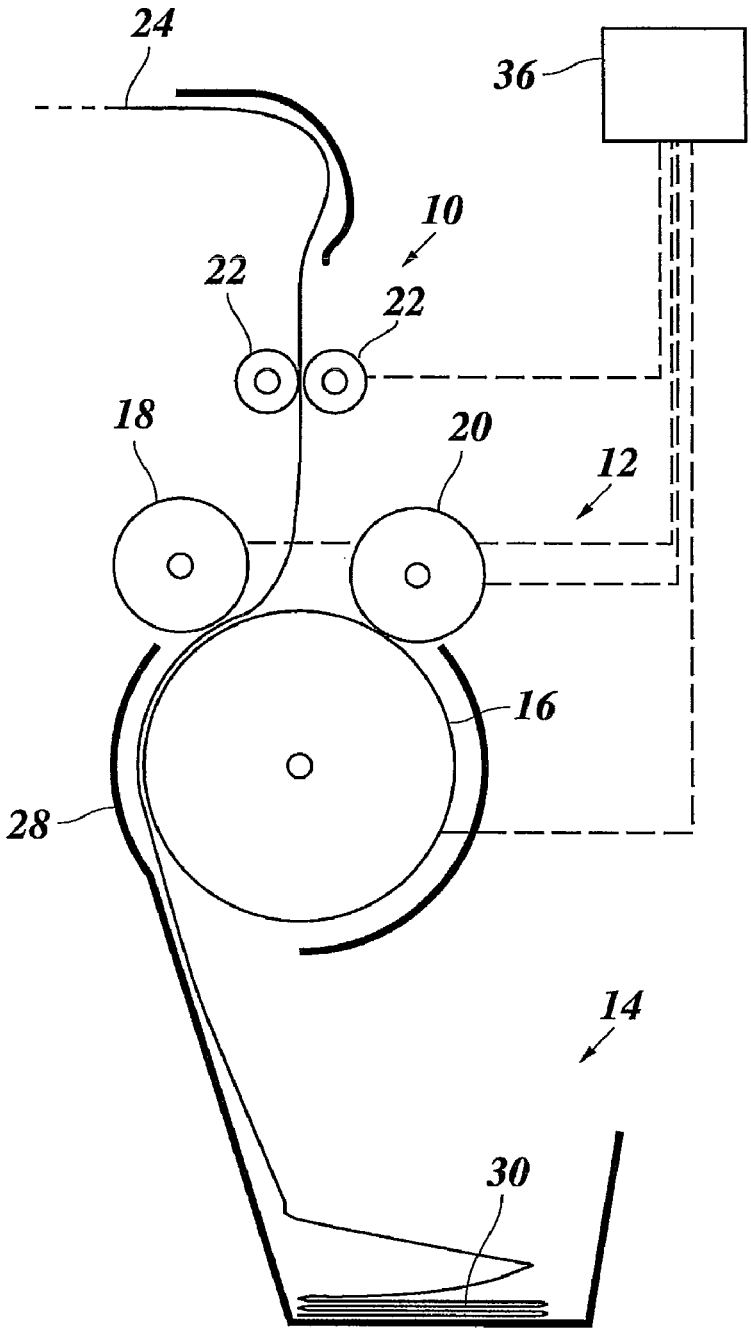

When the leading edge 38 of the sheet 24 reaches the surface of the folding substrate 16, and the drum 16 is driven in the direction indicated by an arrow A, the sheet 24 is deflected towards the pinching nip between the drum 16 and the first press cylinder 18 in FIG. 2.

Then, when a certain length of the sheet 24 has been fed through the feeding nip, as shown in FIG. 2, the direction of rotation of the drum 16 is reversed (direction B), while the feed rollers 22 continue to feed the trailing part of the sheet 24 downwardly or at least are held stationary so as to prevent the sheet 24 from being pushed upward again. As a consequence, the sheet 24 forms a curvature 40 bulging towards the second press cylinder 20 in FIG. 3. When this curvature is caught between the press cylinder 20 and the surface of the drum 16, it is drawn into the nip between these two members, so that a rear fold 42 (FIG. 1) is formed in the sheet 24.

The drum 16 is further rotated in direction B. Then, when a certain length of the sheet 24 has been fed through the feeding nip, the direction of rotation of the drum 16 is again reversed (direction A), and the process is carried out in an analogous way as described above, thereby forming a front fold 44 (FIG. 1) between the first press cylinder 18 and the drum 16.

The drum 16 is then further rotated in the direction A, and, when a certain length of the sheet 24 has been fed through the feeding nip again, the process for forming a rear fold 42 is repeated, again.

Depending on the folding capacity of the folding unit 12, a number of front folds 44 and rear folds 42 is formed, thereby creating the closely folded package 30 on the drum 16 (FIG. 1). The distance between to neighboring folds may, for example, be in the range of 10 to 30 cm.

The folding method according to the invention will now be explained in conjunction with FIG. 1 and FIGS. 3 to 8.

After the folded package 30 (FIG. 1) has been created as described above, the folded package 30 is unloaded from the folding substrate 16 (FIG. 3) and discharged. The package 30 is guided by a guide member 28 to the delivery unit 14, and, in the described embodiment, is deposited on the tray 34 (FIG. 4) in a loosely stacked configuration. While the package 30 is unloaded and discharged to the delivery unit 14, a rear part of the sheet 24 is held back in the nip between the first press cylinder 18 and the drum 16.

Figure 5:
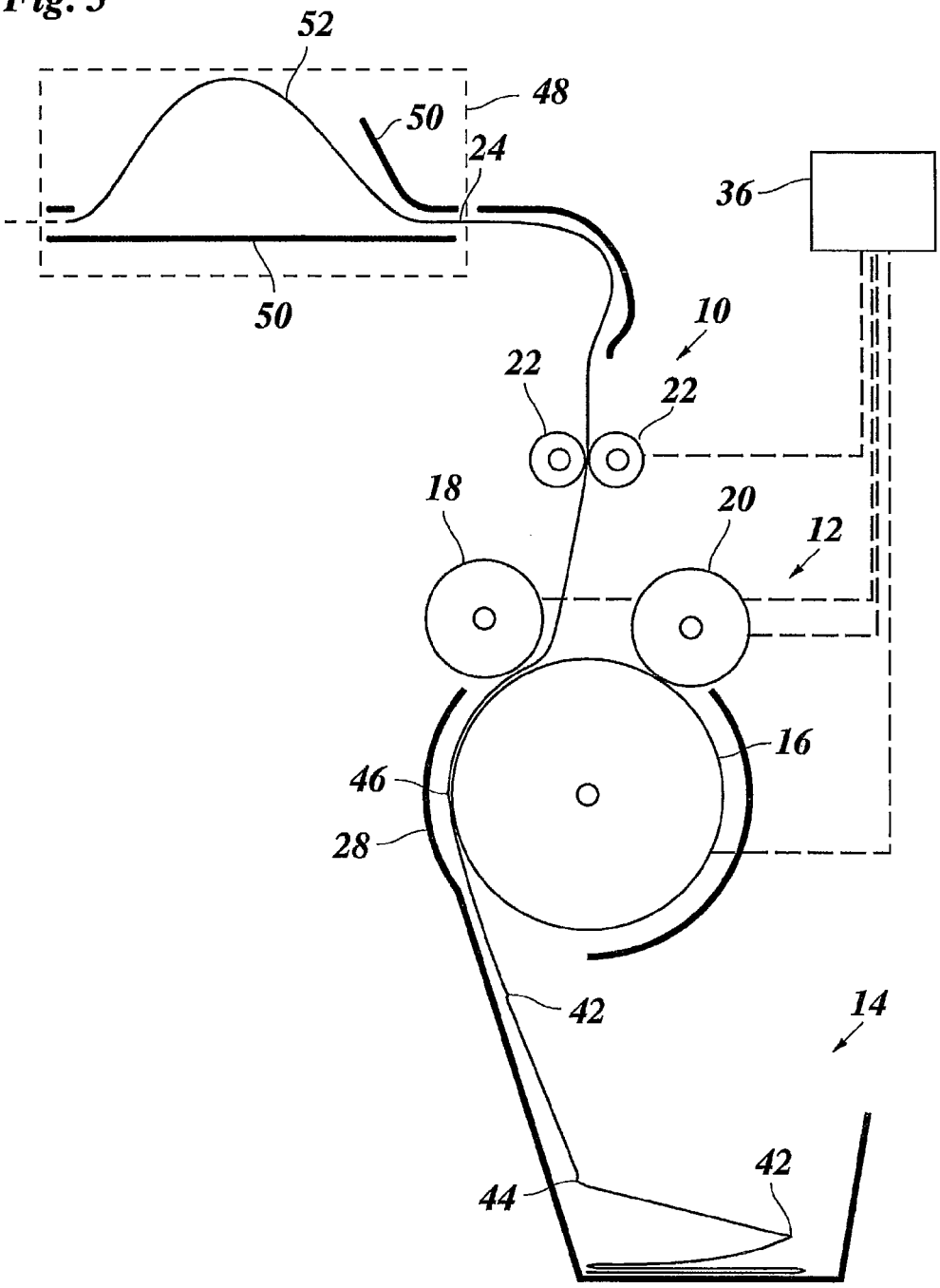

Then, the direction of rotation of the drum 16 is reversed (direction B), and the direction of rotation of the feed rollers 22 is reversed in order to retract the sheet 24 for a certain length, until the last folded front fold 46 is on the support surface of the folding substrate 16, again. This is shown in FIG. 5. Thereby, at least said front fold 46 of the package 30 is unfolded. In the retracting step, the sheet 24 may be retracted by, for example, at least 30 to 40 cm, depending on the length of the folding intervals, the structure of the folding unit 12 and on the distance by which the folded package 30 has to be moved to unload it from the folding substrate 16.

The retracted length of the sheet 24 is buffered in a buffer unit 48 comprising guide members 50 which allow the forming of a blouse 52 of the sheet 24, as is schematically illustrated in FIG. 5. The buffer unit 48 may also buffer a new part of the sheet 24 that is fed to the folding apparatus during retracting the sheet 24.

During the folding process of folding the package 30 as described above, there is always a part of the folded package 30 between the press cylinders 18 and 20 on top of the drum 16. This side of the first press cylinder 18 is referred to as the first side in the following. When the package 30 is unloaded, however, the package 30 is completely moved towards the other, second side of the press cylinder 18, so that the package 30 is released from the pinching nip between press cylinder 18 and the drum 16.

Figure 6:
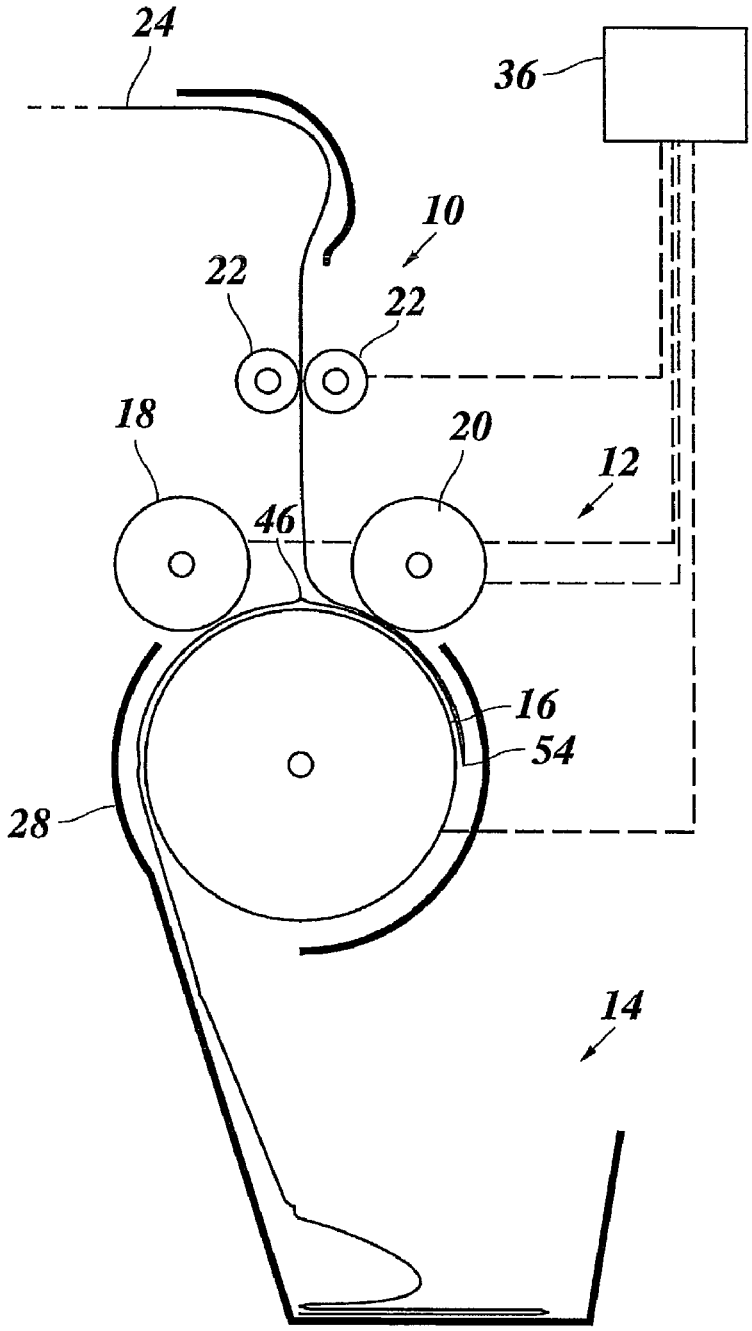
Figure 7:
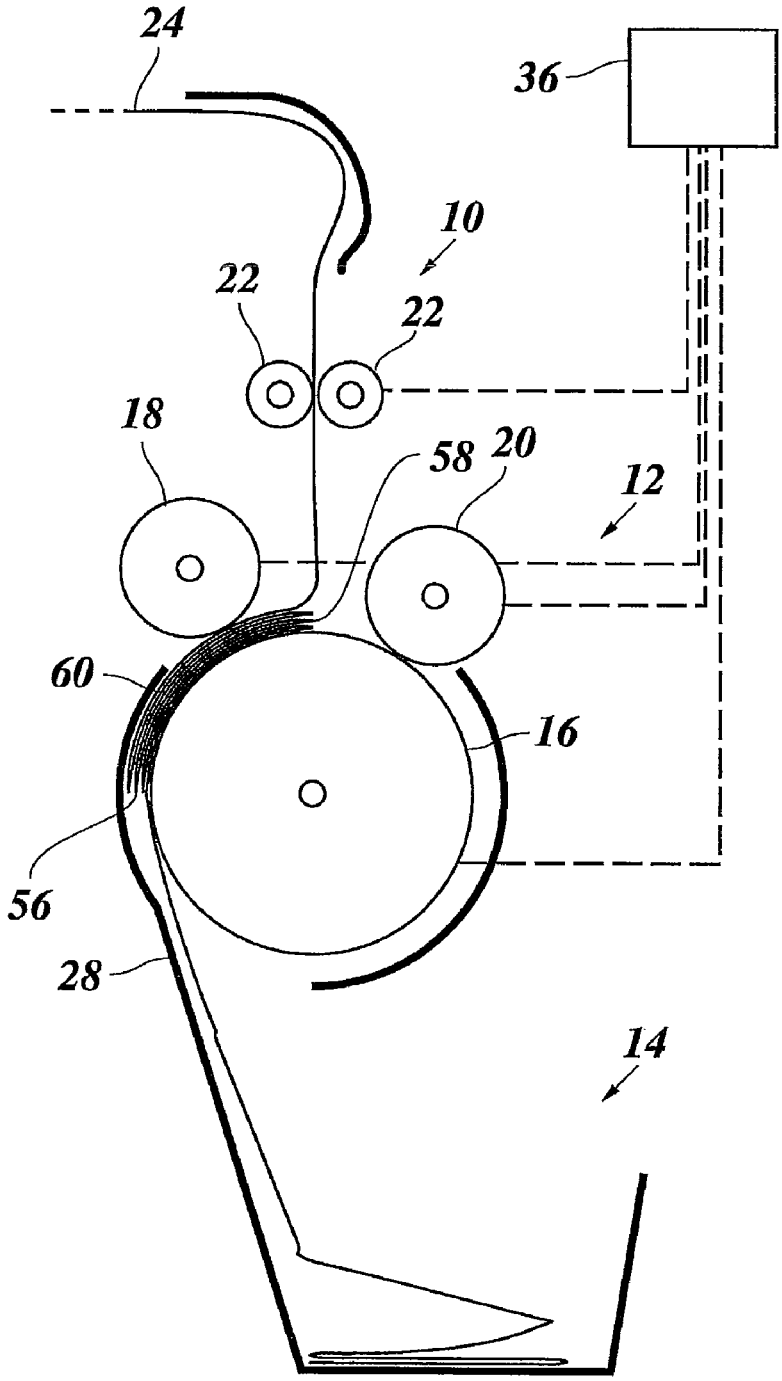

Then, the sheet 24 is repositioned on the folding substrate 16, and a new rear fold 54 is formed between press cylinder 18 and drum 16 such that the sheet length between the last folded front fold 46 and the first new rear fold 54 is the same as between neighboring front folds 44 and rear folds 42 of the first folded package 30 (FIG. 6). Then, the folding step of folding a folded package is repeated, and new front folds 56 and rear folds 58 are folded on top of front fold 46 and rear fold 54. Thereby, a new folded package 60 is formed, as shown in FIG. 7.

The new folded package 60 is then unloaded from the folding substrate 16 and discharged to the delivery unit 14. The sheet 24 is guided by the guide member 28, so that the previously unfolded folds of the first package 30 form or refold again, and the new folded package 60 is positioned adjacent to the previously folded package 30. In the example in FIG. 8, the new folded package 60 lies on top of the folded package 30. The situation shown in FIG. 8 is similar to the situation shown in FIG. 4, however, the folded packages 30 and 60 together form a larger folded package in the delivery unit.

Although some of the folds of the package 30 had been unfolded, the folding process has changed the structure of the sheet 24 at the folds, so that the folds are still present in the sheet 24 and are easily refolded into their previously folded shape without the need of pressing the folds again in a pinching nip.

Figure 8:
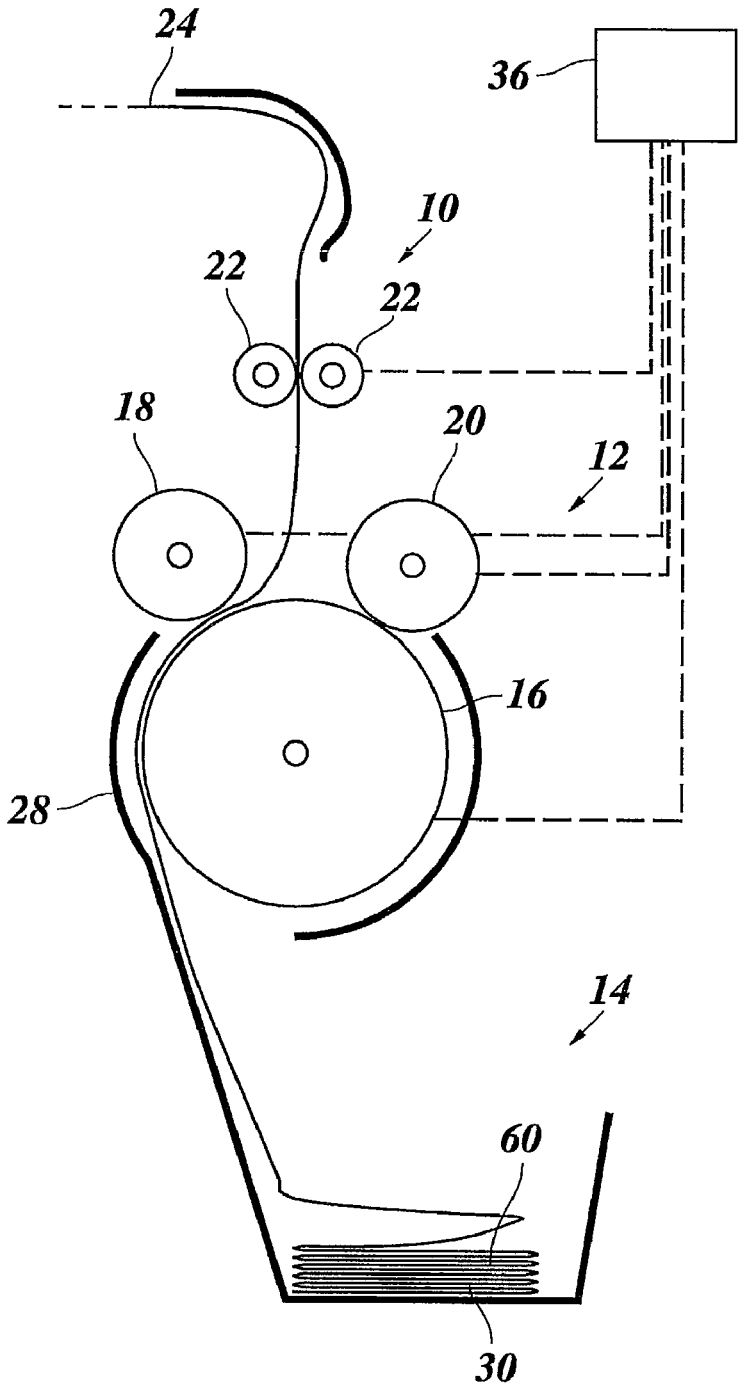

As illustrated in FIG. 8, the folding intervals and folding orientations of the folds of the new folded package 60 and folding intervals and folding orientations of the folds of the previous folded package 30 together form a regular fanfolded pattern. That is, the new front folds 56 lie on top of the previous front folds 44, and the new rear folds 58 lie on top of the previous rear folds 42.

Now, the sheet 24 may be repositioned again, and a further folding step may be executed. When folding the sheet 24 is completed, the last folded package may be discharged to the delivery unit 14 without holding back a part of the sheet 24. Then, the sheet 24 forms one folded package.

Figure 9:
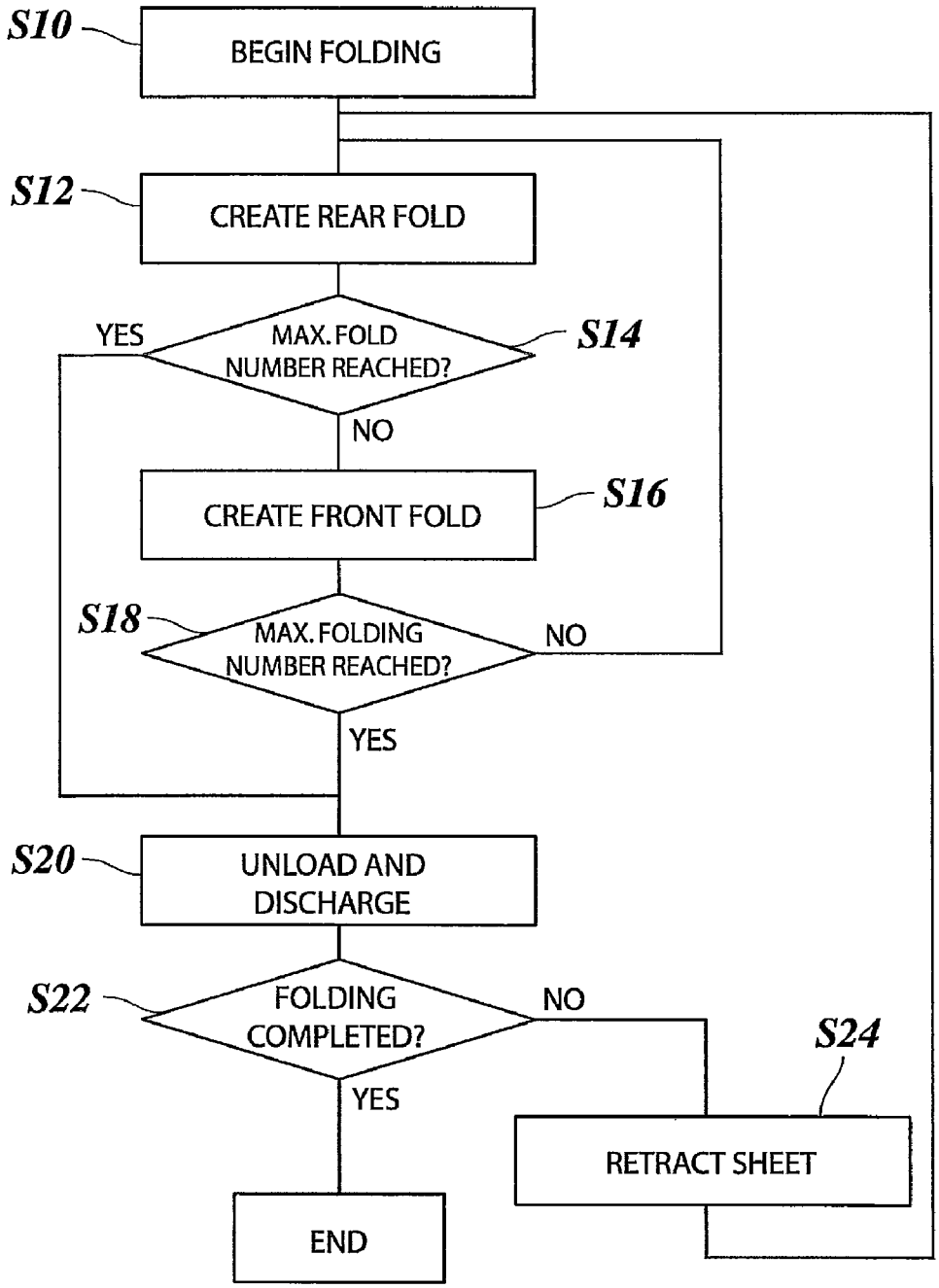
FIG. 9 is a flow chart illustrating the folding method.

FIG. 9 illustrates the operation flow of the folding steps described above, corresponding to a folding program executed, e.g., by the control unit 36 (FIG. 1), which controls the folding unit 12 and the feed unit 10.

When the front edge of the sheet 24 is fed to the folding unit 12, the folding process begins (step S10). First, for example, a rear fold 42 is created (step S12). Then, in step S14, it is checked whether the maximum number of folds that can be handled by the folding unit 12 is reached, or whether the sheet 24 is folded completely. If this is not the case, a front fold 44 is created in step S16.

In step S18, the same criteria as above are checked, and if another fold is to be formed, the process is repeated from Step S12 on.

When, after step S12 or after step S16, the maximum number of folds has been reached, or the sheet 24 has been folded completely, the created folded package 30 is unloaded and discharged from the folding unit 12 to the delivery unit 14 in step S20. The rear part of the sheet 24 is held back in the folding unit 12, thereby unfolding at least one fold.

In step S22, it is checked whether the sheet 24 has been folded completely. If this is the case, the folding process ends. The sheet may be completely discharged.

If the folding is to be continued, the sheet 24 is retracted in order to reposition the last folded front fold 46 (step S24), and the folding process is repeated beginning with step S12.

Figure 10:
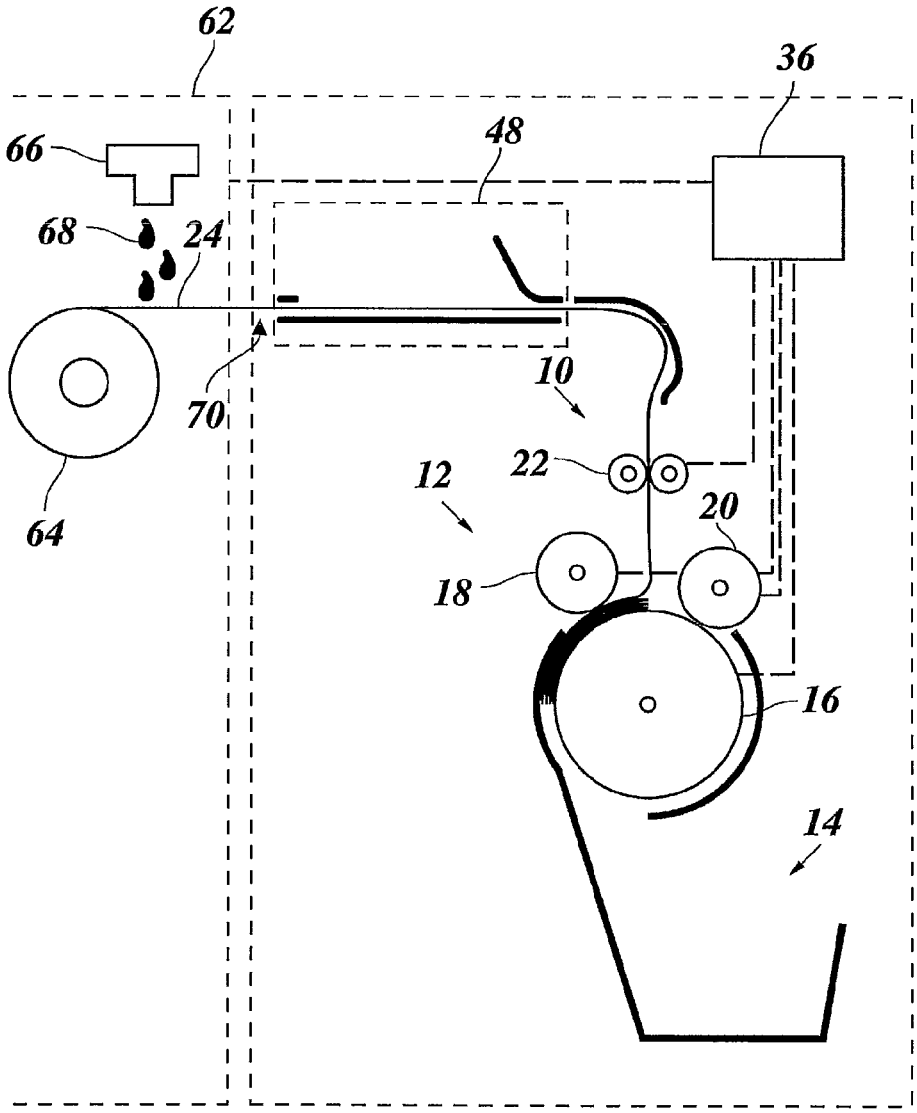
FIG. 10 is a schematic view of an in-line combination of a printing apparatus and the folding apparatus.

FIG. 10 shows the folding apparatus integrated in an in-line combination with a printer 62 or printing apparatus. The sheet 24 is fed from a supply roll 64 towards a printing engine. The printing engine is schematically depicted by ink jet head 66, jetting drops of ink 68 towards the sheet 24 in an image-wise fashion. As it is indicated in FIG. 10, the control unit 36 executing the folding program is also connected to the printer 62. The in-line combination of the printer 62 and the folding apparatus is configured such that the leading edge of the sheet 24 is transported from the exit of the printer 62 to an entrance 70 of the folding apparatus. The folding program is executed as described above. After finishing the folding program, a large folded package including packages 30 and 60 is discharged into the delivery unit 14, from which the operator is able to take out the folded package.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A folding apparatus, comprising:

a folding unit configured to repeatedly fold a sheet in order to create a folded package;

a feed unit configured to feed a sheet to be folded to the folding unit;

a delivery unit configured to discharge the folded sheet; and a control unit configured to control the feed unit to feed the sheet to the folding unit, control the folding unit to fold the sheet repeatedly to create the folded package, and control the delivery unit to discharge at least a part of the folded package from the folding unit, wherein while at least a part of the folded package is discharged from the folding unit, the control unit is configured to control the feed unit to retract back a part of the sheet so as to unfold at least one fold of the folded package, wherein after at least a part of the folded package has been discharged from the folding unit, the control unit is configured to control the folding unit to repeat folding the sheet so that at least a section of the sheet which has not been folded is folded, thereby creating a new folded section, and wherein the new folded section and the previously folded package are continuous.

2. The folding apparatus according to claim 1, wherein the folding unit comprises:

a folding substrate forming a support surface for the sheet and adapted to be driven back and forth in a surface direction of said support surface, and a pinch structure having at least one pinch member configured to fold the sheet between the support surface and said at least one pinch member.

3. The folding apparatus according to claim 1, further comprising a buffer unit configured to buffer a section of the sheet, said buffer unit being arranged upstream of the folding unit.

4. The folding apparatus according to claim 1, wherein the feed unit is adapted to supply and retract the sheet.

* * * * *